US011724722B2

(12) United States Patent
Long et al.

(10) Patent No.: US 11,724,722 B2
(45) Date of Patent: Aug. 15, 2023

(54) ATTACHMENT MOUNTING APPARATUS FOR A RAILROAD COUPLER

(71) Applicant: Siemens Mobility, Inc., New York, NY (US)

(72) Inventors: Zhenzhong Long, Louisville, KY (US); Nathan Fletcher, Louisville, KY (US)

(73) Assignee: Siemens Mobility, Inc., New York, NY (US)

( * ) Notice: Subject to any disclaimer, the term of this patent is extended or adjusted under 35 U.S.C. 154(b) by 390 days.

(21) Appl. No.: 16/990,448

(22) Filed: Aug. 11, 2020

(65) Prior Publication Data

US 2022/0048546 A1 Feb. 17, 2022

(51) Int. Cl.
*B61G 7/00* (2006.01)
*B61L 15/00* (2006.01)

(52) U.S. Cl.
CPC ..... *B61G 7/00* (2013.01); *B61L 15/0054* (2013.01)

(58) Field of Classification Search
CPC ... B61G 7/00; B61G 7/06; B61G 7/08; B61G 7/10; B61G 7/14; B61L 15/0054
See application file for complete search history.

(56) References Cited

U.S. PATENT DOCUMENTS 4,520,662 A * 6/1985 Schmid ..... B61G 7/00 73/129
5,235,849 A * 8/1993 Egerton ..... B61L 15/02 73/129
6,135,665 A * 10/2000 Alfieri ..... B61G 7/00 213/77
9,073,561 B2 * 7/2015 Egerton ..... B61G 1/02
2002/0162928 A1 * 11/2002 Kane ..... B61D 29/00 248/231.51

* cited by examiner

*Primary Examiner* — Robert J McGarry, Jr.

(57) ABSTRACT

An apparatus for mounting an attachment structure (such as an EOT) to a railroad coupler includes a base, a locking member (J-hook), a bolt and one or more spring elements. The base includes a mounting portion for the attachment structure and a sleeve insertable through the attachment structure. The base, the J-hook and the bolt cooperate such that the J-hook is rotated from an unlocked position to a locked position by torque applied via the bolt head. Consequently, the J-hook shaft is pulled inside the sleeve and the J-hook aligns with a clamp face of the base to clamp a portion of the coupler therebetween. Responsive to the applied torque, the one or more spring elements are compressed to allow mechanical engagement between a first surface and a second surface, producing a mechanical torque opposing the applied torque, which reduces axial forces on the J-hook.

20 Claims, 9 Drawing Sheets

ATTACHMENT MOUNTING APPARATUS FOR A RAILROAD COUPLER

TECHNICAL FIELD

The present disclosure is directed generally to the field of locomotives, and particularly to installation of an attachment structure, such as an end of train device (EOT), to a railroad coupler.

BACKGROUND

Railroad couplers include articulated coupling arrangements that are used for the purpose of connecting adjacently arranged ends of railway transport vehicles. Railroad couplers may often be used as a mounting point for attachment structures, such as an end of train device (EOT). An EOT is typically installed on a railroad coupler fixed to the last train car of many modern freight trains. An EOT may house one or more sensors, for example for measuring brake pipe pressure, among others, and may also contain data communication equipment for transmitting sensor data to the locomotive crew.

To install an EOT to a railroad coupler, a mounting apparatus is used, which typically provides a mechanism for locking and unlocking the EOT in relation to the railroad coupler. For this purpose, the mounting apparatus may include a locking member which may be rotated from an unlocked position to a locked position, and vice versa. The torque applied for locking the EOT may lead to failure of the locking member and/or other parts of the mounting apparatus over a period of time.

SUMMARY

Briefly, aspects of the present disclosure are directed to an improved apparatus for mounting an attachment structure to a railroad coupler, and a corresponding method that may be used, in some embodiments, to retrofit an existing apparatus with the improved features.

A first aspect of the disclosure sets forth an apparatus for mounting an attachment structure to a railroad coupler. The apparatus comprises a base comprising a first clamp face, a mounting portion for the attachment structure and an elongated sleeve extending from the mounting portion. The sleeve is insertable through attachment structure. The apparatus further comprises a locking member comprising a hook defining a second clamp face and a lock shaft extending from the hook, the lock shaft being hollow for at least a portion of the length thereof and insertable through a first end of the of the sleeve adjacent the mounting portion. The apparatus further comprises a bolt comprising a bolt head and a bolt shaft. The bolt shaft is insertable through a second end of the sleeve opposite the first end and configured to be in threaded engagement with an inner surface of the hollow portion of the lock shaft after the lock shaft is inserted through the first end of the sleeve. The locking member is configured to be rotated from an unlocked position to a locked position by torque applied via the bolt head, whereby the locking member is pulled inside the sleeve and the second clamp face aligns with the first clamp face to clamp a portion of the railroad coupler therebetween. The apparatus further comprises one or more spring elements configured to be compressible by relative movement between the bolt and the base responsive to the applied torque, to produce a clamping force between the first and second clamp faces. Compression of the one or more spring elements causes a first surface to mechanically engage with a second surface to generate a mechanical torque that opposes the applied torque.

A second aspect of the disclosure sets forth a method for mounting an attachment structure to a railroad coupler. The method comprises arranging a base, a locking member, a bolt and one or more spring elements. The base comprises a first clamp face, a mounting portion for the attachment structure and an elongated sleeve extending from the mounting portion, the sleeve having a first end adjacent the mounting portion and a second end opposite the first end. The locking member comprises a hook defining a second clamp face and a lock shaft extending from the hook, the lock shaft being hollow for at least a portion of the length thereof. The bolt comprises a bolt head and a bolt shaft. The method comprises inserting the sleeve of the base through the attachment structure, inserting the bolt through the second end of the sleeve, and inserting the lock shaft through the first end of the sleeve such that the bolt shaft is in threaded engagement with an inner surface of the hollow portion of the lock shaft. The method then comprises rotating the locking member from an unlocked position to a locked position by torque applied via the bolt head, whereby the locking member is pulled inside the sleeve and the second clamp face aligns with the first clamp face to clamp a portion of the railroad coupler therebetween. The one or more spring elements are compressed by relative movement between the bolt and the base responsive to the applied torque, to produce a clamping force between the first and second clamp faces. Compression of the one or more spring elements causes a first surface to mechanically engage with a second surface to generate a mechanical torque that opposes the applied torque.

BRIEF DESCRIPTION OF THE DRAWINGS

The foregoing and other aspects of the present disclosure are best understood from the following detailed description when read in connection with the accompanying drawings. To easily identify the discussion of any element or act, the most significant digit or digits in a reference number refer to the figure number in which the element or act is first introduced.

DETAILED DESCRIPTION

Figure 1:
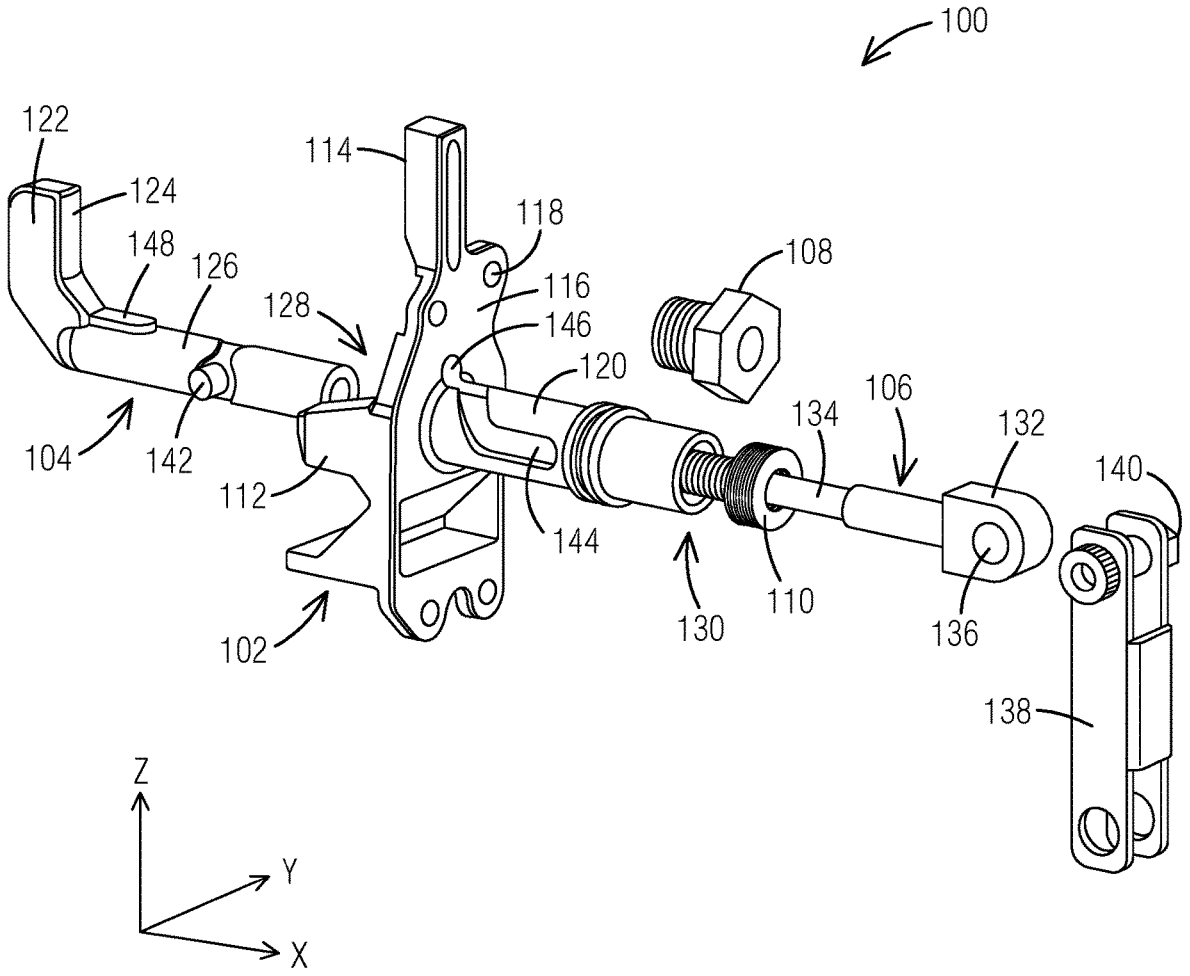
FIG. 1 is an exploded view of an apparatus having a J-hook mounting design.

Various technologies that pertain to systems and methods will now be described with reference to the drawings, where like reference numerals represent like elements throughout. The drawings discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged apparatus. It is to be understood that functionality that is described as being carried out by certain system elements may be performed by multiple elements. Similarly, for instance, an element may be configured to perform functionality that is described as being carried out by multiple elements. The numerous innovative teachings of the present application will be described with reference to exemplary non-limiting embodiments.

To facilitate understanding of the various views shown in the drawings, reference may be made to the mutually orthogonal X, Y, and Z axes that are consistently defined in the drawings.

Referring to FIG. 1-5, one possible construction of an apparatus 100 is shown that may be used for mounting an attachment structure to a railroad coupler. Although the attachment structure described here is an EOT, teachings of the present disclosure may apply to mounting of other types of attachments to a railroad coupler.

Figure 2:
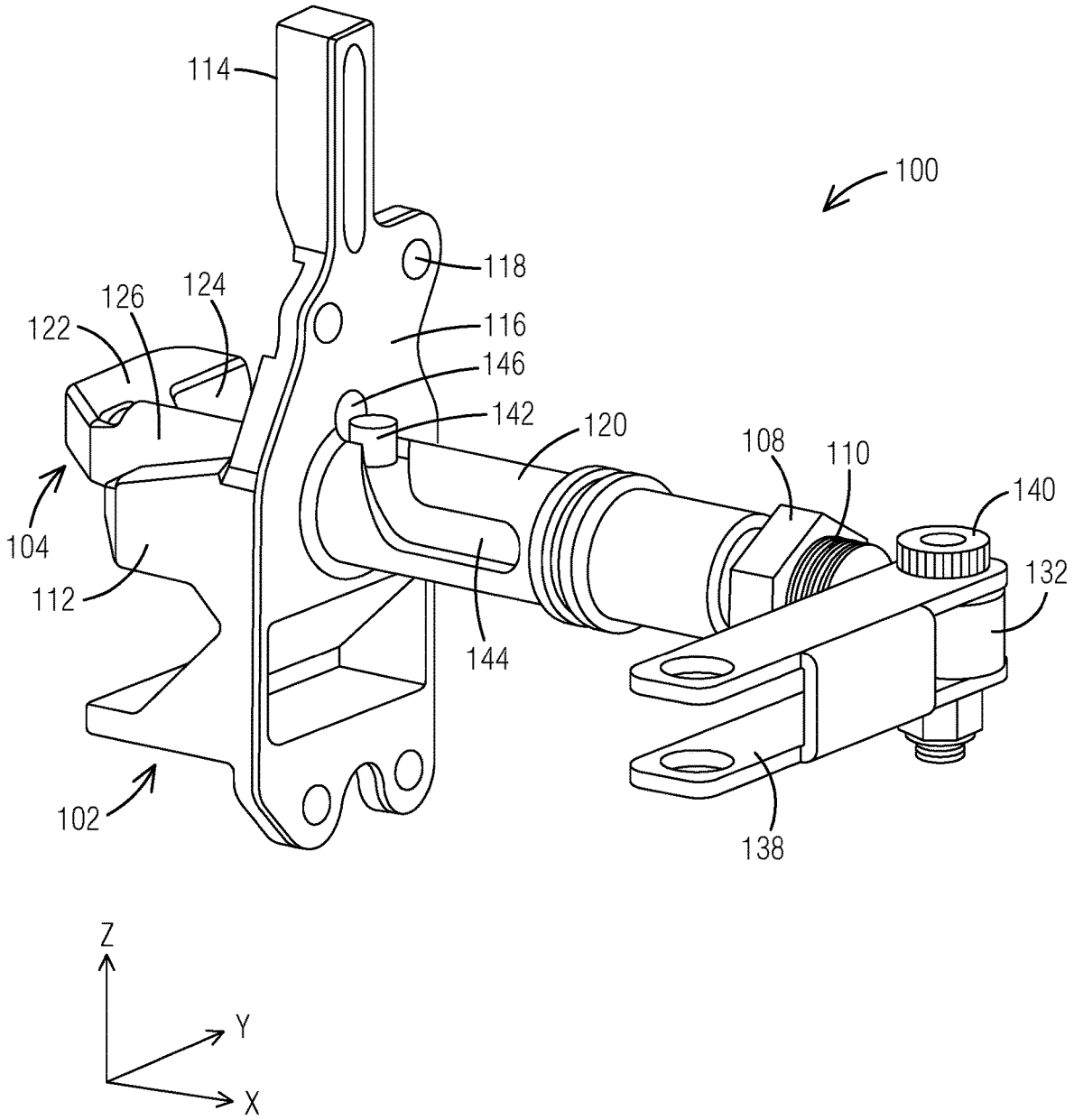
FIG. 2 is a perspective view of the apparatus of FIG. 1 after assembly, in an unlocked position.
Figure 3:
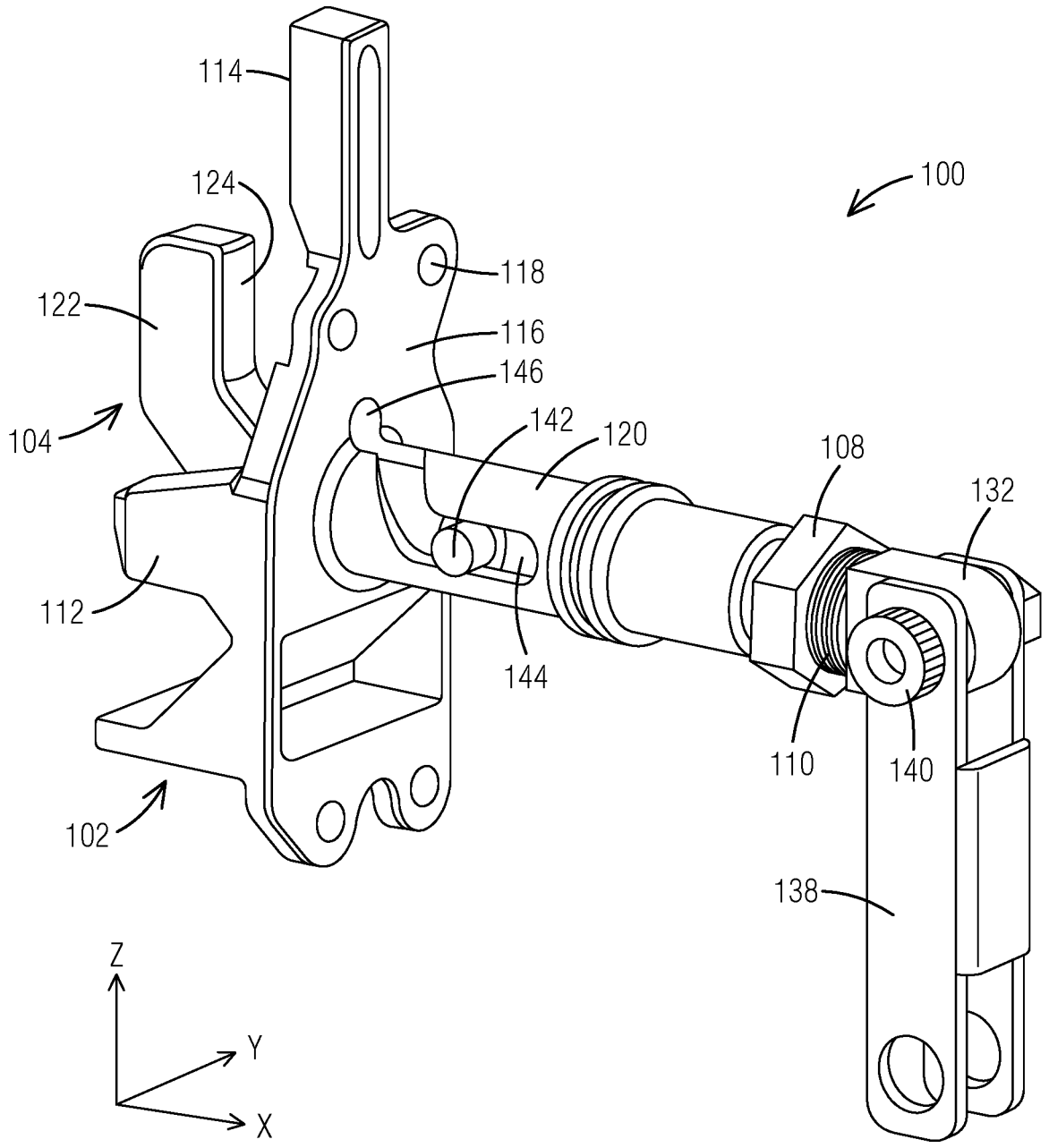
FIG. 3 is a perspective view of the apparatus of FIG. 1 after assembly, in a locked position.
Figure 4:
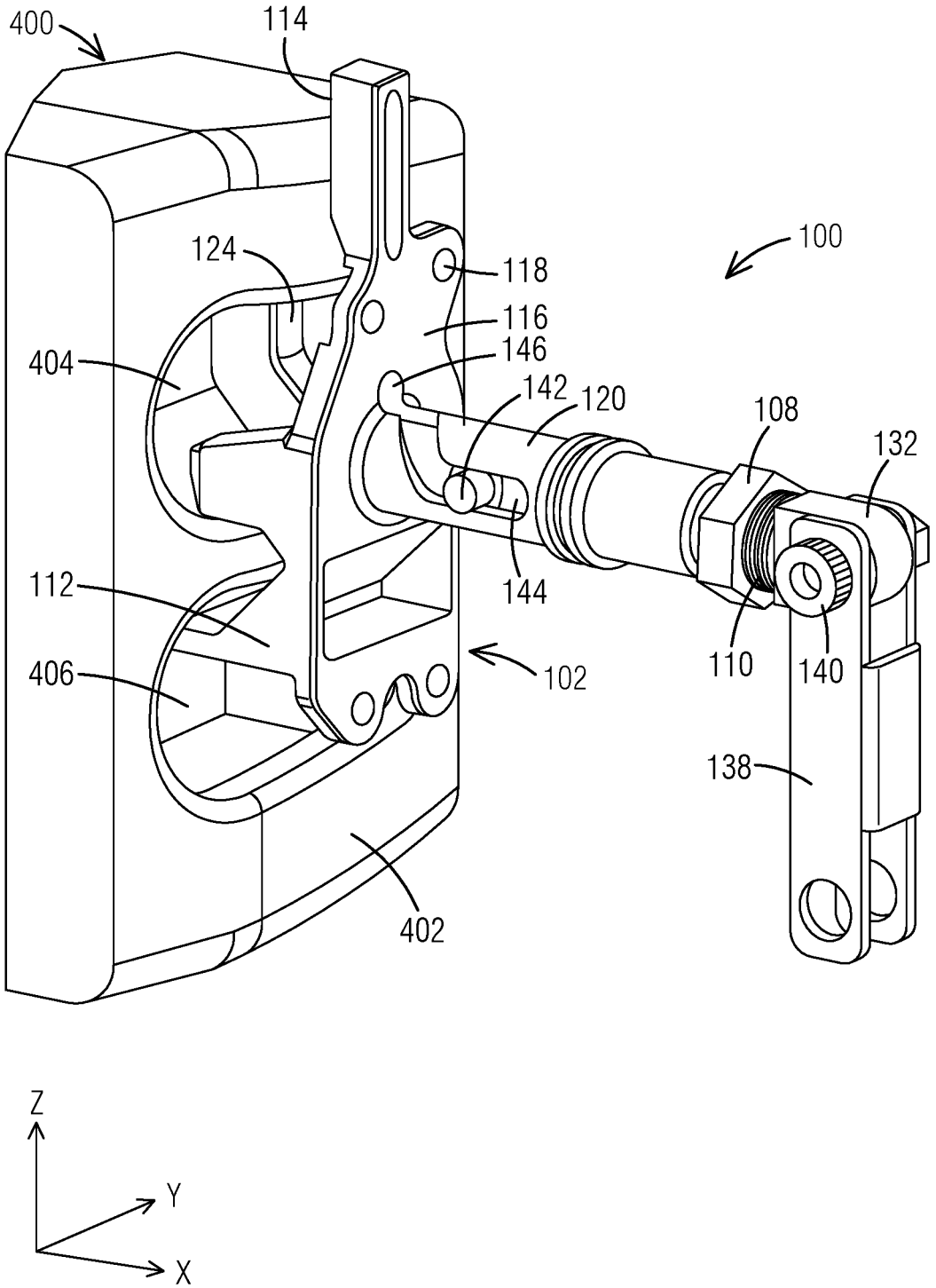
FIG. 4 is a perspective view of the apparatus of FIG. 1 when mounted to a railroad coupler.
Figure 5:
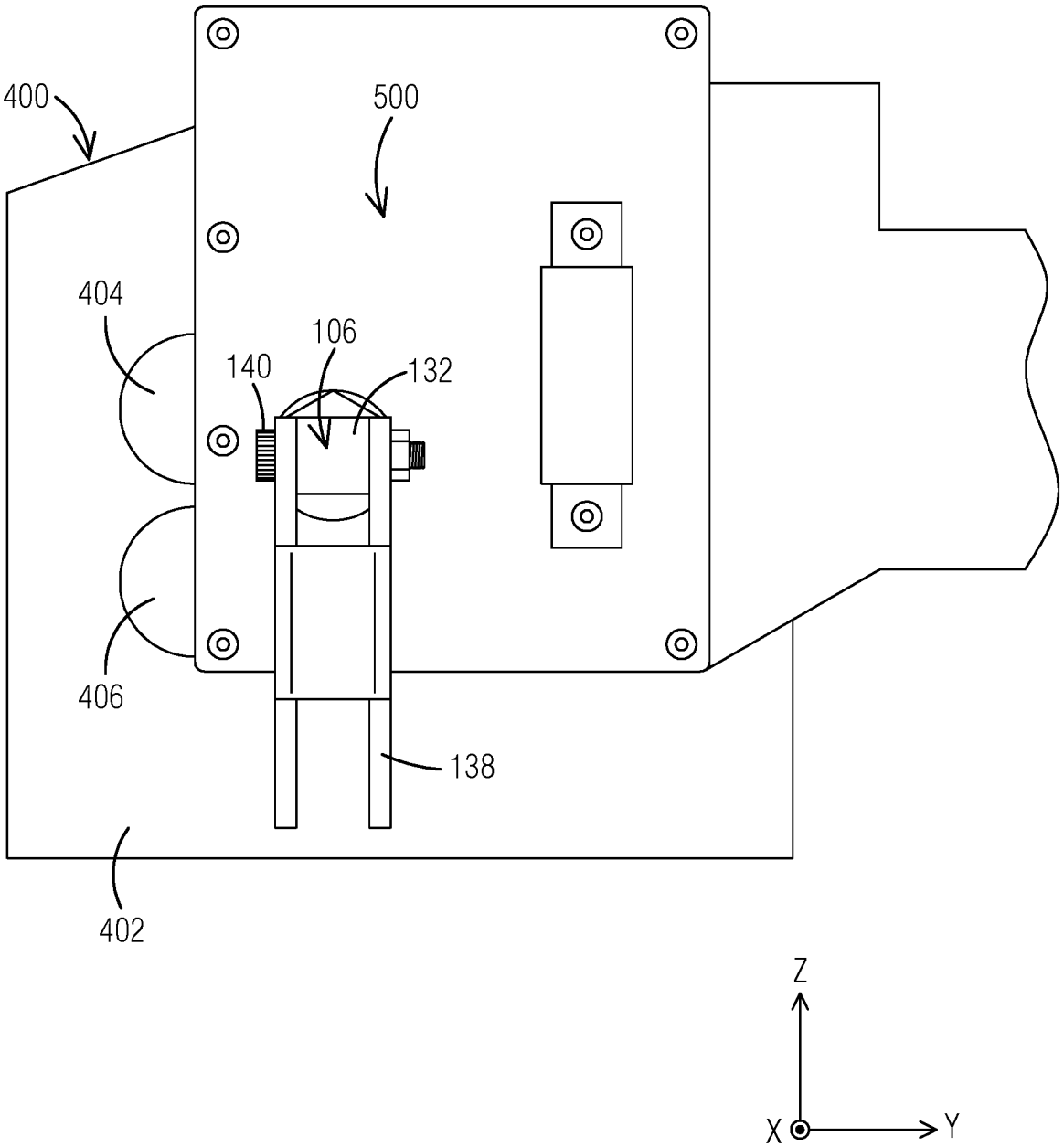
FIG. 5 is an end view of the apparatus of FIG. 1, also showing an EOT installed on the railroad coupler.

FIG. 1 shows an exploded view or an unassembled state of the apparatus 100. FIG. 2 and FIG. 3 depict an assembled state of the apparatus 100 in an unlocked position and in a locked position respectively. FIG. 4 illustrates the apparatus 100 when mounted to a railroad coupler 400. As shown, key functional components of the apparatus 100 include a base 102, a locking member 104, a bolt 106 and one or more spring elements 110. The EOT is intentionally not shown in the assembled views in FIG. 2-4 to expose the functional components of the apparatus 100. FIG. 5 illustrates an end view of the apparatus 100 showing the EOT 500 installed on the railroad coupler 400.

The base 102 comprises a first clamp face 114, a mounting portion 116 for mounting the EOT and an elongated sleeve 120 extending from the mounting portion 116. The first clamp face 114 of the base 102 cooperates with a second clamp face 124 of the locking member 104 to clamp a portion of the railroad coupler 400 therebetween, as shown in FIG. 4. The sleeve 120 may be generally cylindrical in construction, extending from a first end 128 to a second end 130. The first end 128 of the sleeve 120 is adjacent the mounting portion 116. The sleeve 120 is insertable through a corresponding hole in the EOT housing from its second end 130 to position the EOT for mounting. The mounting portion 116 may comprise one or more mounting points 118 (in this example, four mounting points 118 are shown) for fastening the EOT to the base 102, for example, via bolted connections. The base 102 may further comprise an engagement portion 112 that may be designed, for example, to engage with a standard railroad coupler. FIG. 4 shows a cutaway of the railroad coupler 400, showing a side face 402 of the coupler 400. As shown in FIG. 4, the engagement portion 112 of the base 102 may be configured to mate into slots 404, 406 provided on the side face 402 of the coupler 400.

The locking member 104 comprises a hook 122 defining the second clamp face 124 and a lock shaft 126 extending from the hook 122. The lock shaft 126 is insertable into the sleeve 120 through the first end 128, such that the hook 122 remains outside the sleeve 120. The lock shaft 126 is hollow, for least a portion along its length. The hollow portion is adjacent to an end of the lock shaft 126 opposite to the hook end, and is internally threaded.

The bolt 106 comprises a bolt head 132 and a bolt shaft 134. The bolt shaft 134 is insertable through the second end 130 of the sleeve 120. An end portion of the bolt shaft 134 is externally threaded (see FIG. 7) to allow the bolt shaft 134 to be in threaded engagement with an inner surface of the hollow portion of the lock shaft 126 after the lock shaft 126 is inserted through the first end 128 of the sleeve 120 (see FIG. 10). In the shown construction, the bolt 106 is an eyebolt, wherein the bolt head 132 defines an eye portion comprising an eye or opening 136 for fastening a handle 138 to the bolt head 132, for example via a bolt 140. Once fastened, the handle 138 extends normal to the bolt axis, allowing an operator to apply torque on the bolt head 132 via the handle 138 for locking an unlocking the apparatus 100. In other constructions, instead of an eyebolt design, the bolt 106 may have a different design, where the bolt head 132 may be accordingly configured to engage with other torque application devices, such as wrenches, for locking or unlocking the apparatus 100.

In the shown configuration, the apparatus 100 further includes a nut 108 installable on the bolt shaft 134. The nut 108 is insertable through the second end 130 of the sleeve 120 and configured to be in a threaded engagement with an inner surface of the sleeve 120. For this purpose, the nut 108 is externally threaded and the sleeve 120 is internally threaded for at least a small portion of its length adjacent to its second end 130 (see FIG. 10).

The one or more spring elements 110 are positionable between the nut 108 and the bolt head 132. The spring elements 110 may include, for example, washers. The present configuration may use one or more Belleville washers or any other construction that allows the washers 110 to be axially compressible in relation to the bolt axis. The one or more washers or spring elements 110 are compressed by torque applied to the bolt head 132 to produce a clamping force between the first clamp face 114 and the second clamp face 124. The number and arrangement of washers or spring elements 110 used may be a matter of design choice based on the clamping force desired.

The assembly of the apparatus 100 involves the steps of arranging the base 102, the locking member 104 and the bolt assembly on the site of the railroad coupler 400. The one or more spring elements (in this example, washers) 110 are mounted on the bolt shaft 134 and slid all the way to the bolt head 132. The nut 108 may then be installed on the bolt 106 such that the one or more spring elements 110 are positioned between the nut 108 and the bolt head 132. Subsequently the sleeve 120 of the base 102 is inserted (from the end 130) through a hole in the EOT housing. Next, the bolt 106 is inserted through the second end 130 of the sleeve 120 and the nut 108 is tightened into a threaded engagement with an inner surface of the sleeve 120. Thereafter, the lock shaft 126 is inserted through the first end 128 of the sleeve 120 such that the bolt shaft 134 is in threaded engagement with an inner surface of the hollow portion of the lock shaft 126. The EOT may be fastened to the mounting points 118 on the base 102 by bolts.

Once the apparatus 100 is assembled, the locking member 104 may be rotated from an unlocked position (see FIG. 2) to a locked position (see FIG. 3) by torque applied via the bolt head 132, in this case, using the torque handle 138 fastened to the eyebolt 106. As the torque is applied, the locking member 104 (in particular, the lock shaft 126) is pulled inside the sleeve 120 due to the threaded engagement between the bolt shaft 134 and the lock shaft 126. In the process, the second clamp face 124 on the hook 122 rotates to align with the first clamp face 114 on the base 102 to clamp a portion of the railroad coupler therebetween (see FIG. 4). In the shown construction, the lock shaft 126 has a pin 142 protruding therefrom. The pin 142 is positioned along the length of the lock shaft 126 such that during rotation of the locking member 104 from an unlocked to a locked position, as the lock shaft 126 is pulled into the sleeve 120, the pin 142 passes through an opening 146 adjacent the first end 128 of the sleeve 120. As the lock shaft 126 continues to be threaded in, the pin 142 engages into a guide channel 144 on the sleeve 120. The guide channel 144 is shaped to guide a rotation of the pin 142 by 90 degrees and limit further rotation of the lock shaft 126. The lock shaft 126 further comprises a step 148 that engages against the sides of the opening 146 to lock the rotation of the locking member 104. During the locking operation, after the second clamp face 124 on the hook 122 contacts the inside surface of the coupler 400 (see FIG. 4), additional torque compresses the one or more spring elements 110, causing a clamping force between the second clamp face 124 on the hook 122 and the first clamp face 114 on the base 102. This clamping force locks the EOT 500 to the coupler 400 (see FIG. 5). The EOT 500 may be uninstalled from the coupler 400 by applying a counter torque to move the locking member 104 from the locked position to an unlocked position.

The large applied torque during installation of the EOT transfers high loads to the locking member 104. For example, high torque on the handle 138 may generate a high axial load on the lock shaft 126, leading to bending failure of the locking member 104. The high torque on the handle 138 may also transfer a high torque to the base 102 through the step 148 and the pin 142. This high torque may cause failure of the lock shaft 126, the step 148, as well as the base 102.

Aspects of the present disclosure address the above described problem by providing a built-in feature that produces an opposing mechanical torque (for example, by frictional forces or interlocking forces) responsive to the applied torque. Specifically, the embodiments described herein are designed such that, responsive to the applied torque, the compression of the one or more spring elements due to relative motion between the base and the bolt causes a first surface to mechanically engage with a second surface, to generate a mechanical torque that opposes the applied torque. The opposing mechanical torque significantly reduces the axial force and torque on the lock shaft and step and the guide channel of the base, thereby prolonging the lifetime of these components.

In one embodiment, a recess may be formed into either the first surface or the second surface, for receiving therein the one or more spring elements. The recess may be sized to a length that fully accommodates the one or more spring elements in a compressed state of the one or more spring elements, and partially accommodates the one or more spring elements in their uncompressed state. This allows the first and second surfaces to remain separated when the one or more spring elements are in their uncompressed state and the first and second surfaces to contact directly when the one or more spring elements are in their compressed state.

Figure 6:
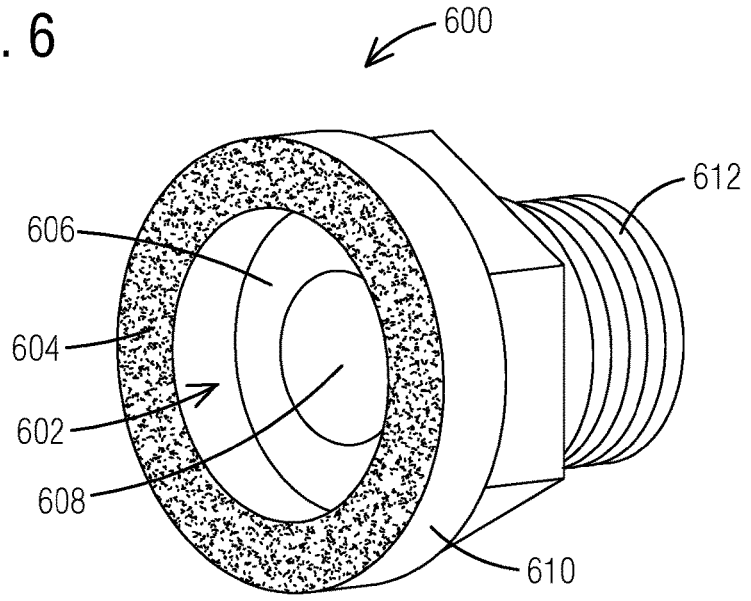
FIG. 6 illustrates a redesigned eyebolt nut according to an exemplary embodiment of the disclosure.
Figure 7:
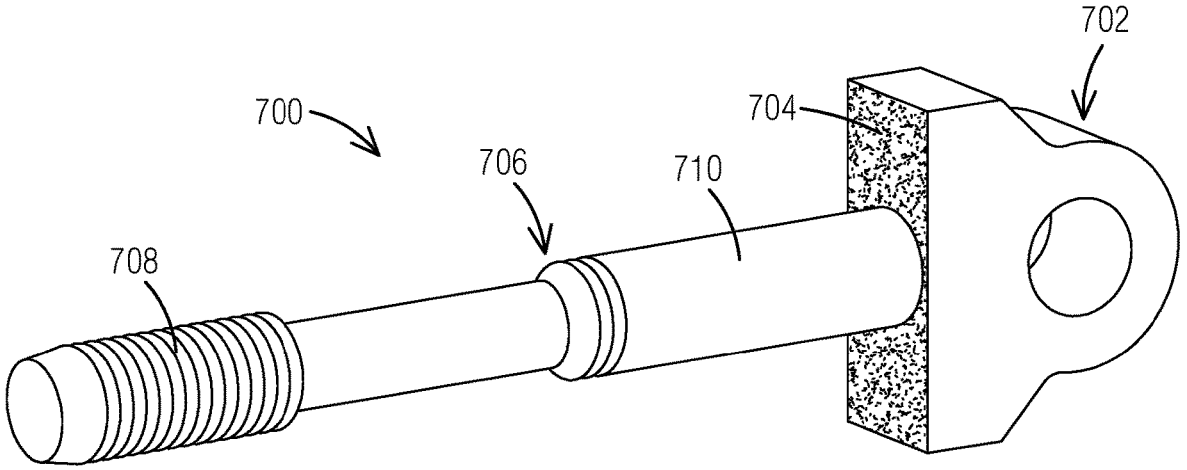
FIG. 7 illustrates a redesigned eyebolt according to an exemplary embodiment of the disclosure.
Figure 8:
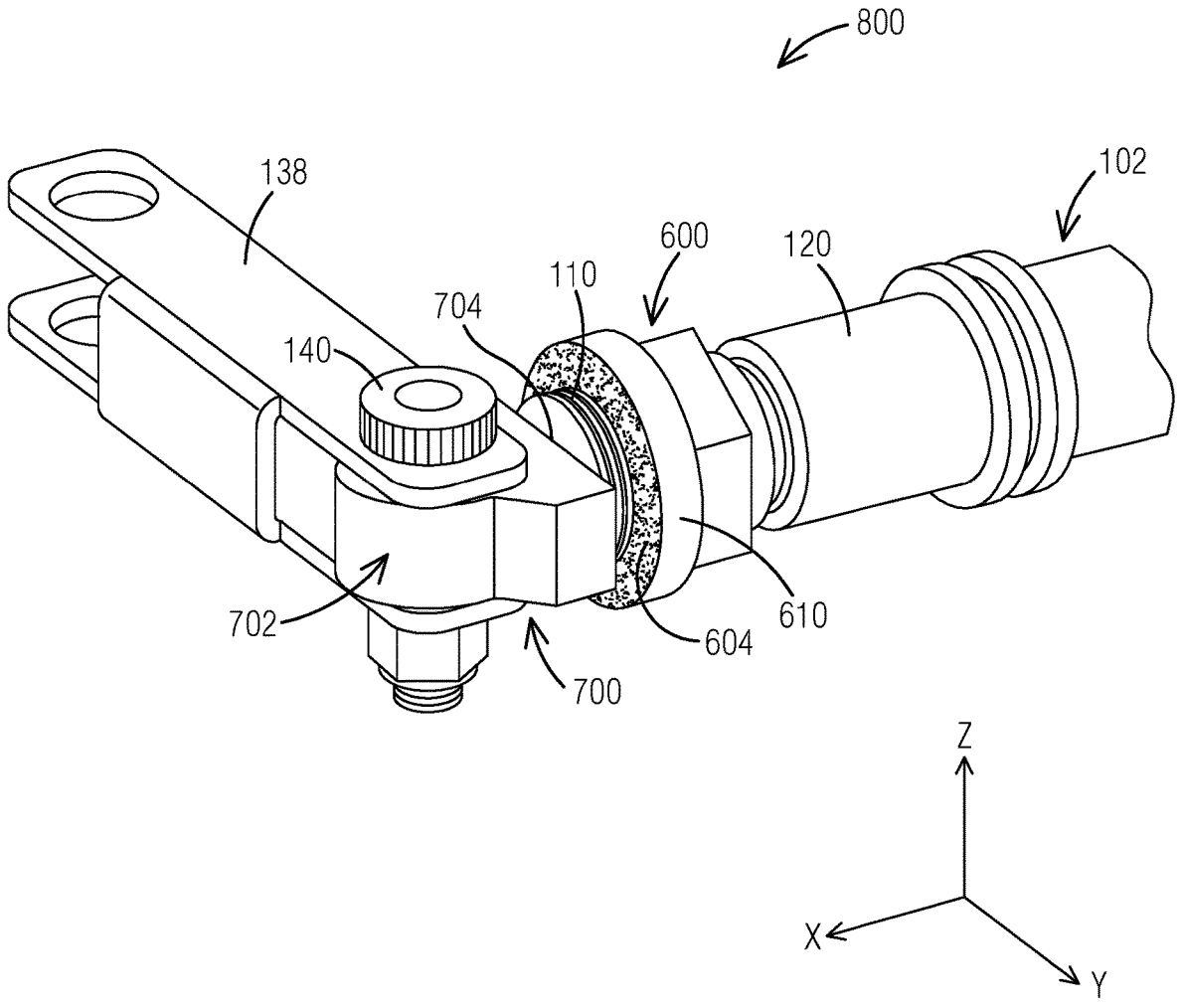
FIG. 8 is a perspective view of an apparatus according to an exemplary embodiment of the disclosure, in an unlocked position.
Figure 9:
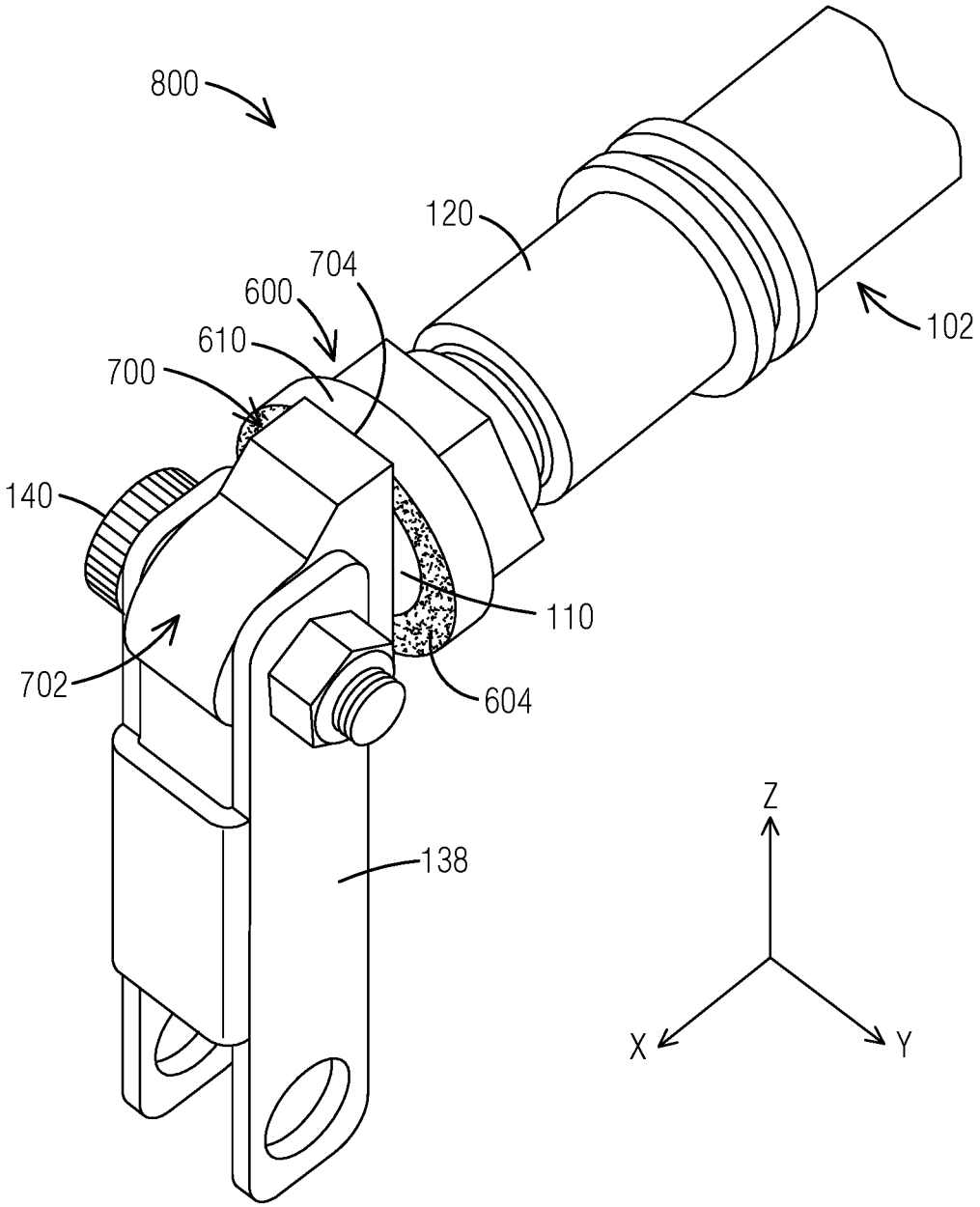
FIG. 9 is a perspective view of the apparatus of FIG. 8, in a locked position.
Figure 10:
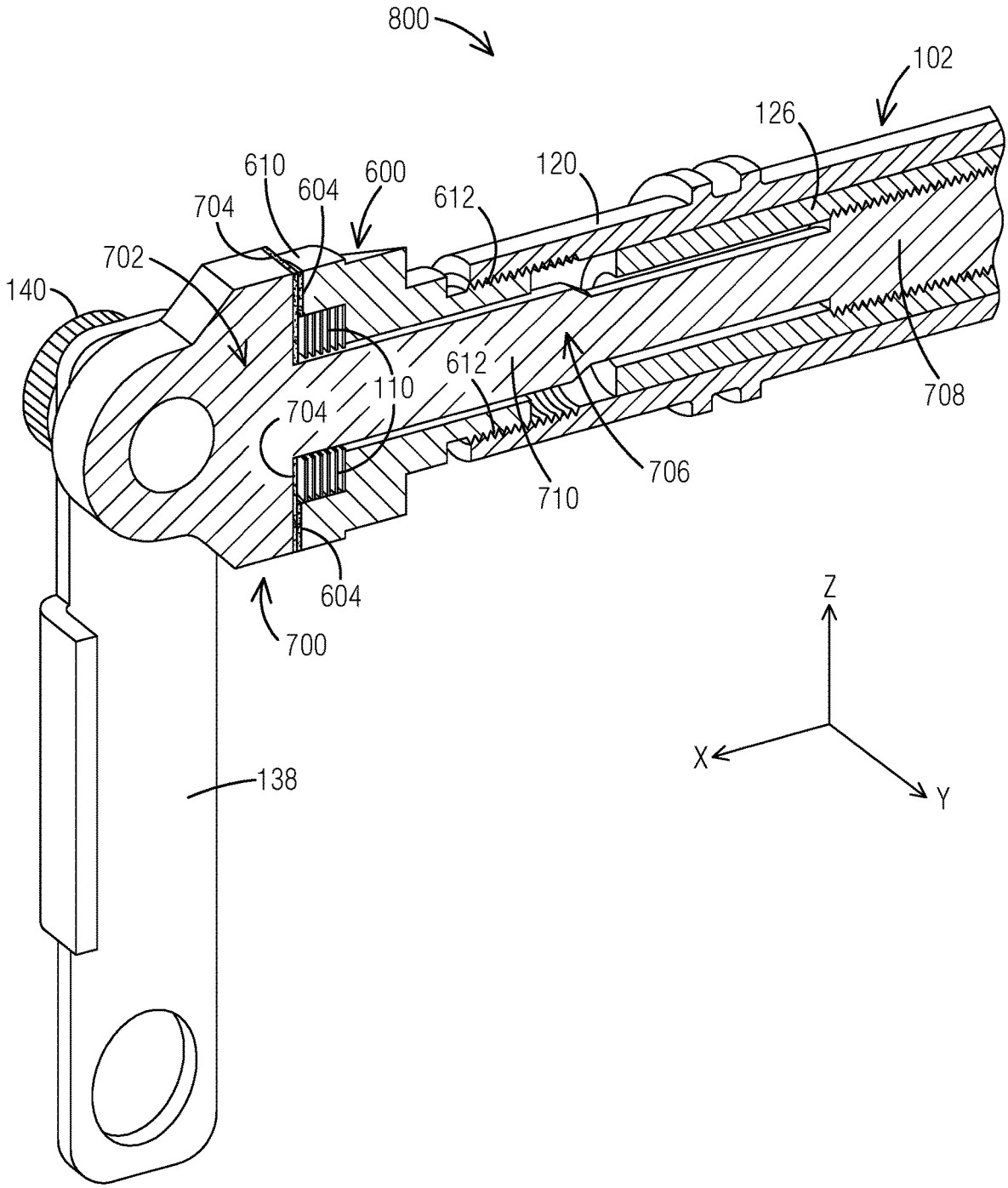
FIG. 10 shows a sectional view of the configuration shown in FIG. 9.

In a first implementation of the above, the first surface is an axial end face of the bolt head and the second surface is an axial end face of the nut. The term "axial" in this context pertains to the bolt axis. An exemplary implementation is illustrated in FIG. 6-10. FIG. 6 and FIG. 7 respectively show an inventive nut 600 and an inventive bolt 700, that cooperate to realize the above-mentioned feature. FIG. 8 and FIG. 9 respectively illustrate an unlocked position and a locked position of a modified mounting apparatus 800 employing the inventive features shown in FIG. 6 and FIG. 7. FIG. 10 is a sectional view of the configuration shown in FIG. 9.

Referring to FIG. 6, an inventive nut 600 is designed to have a recess 602 to receive therein the one or more spring elements 110. The spring elements 110 may comprise washers, as in the previously described configuration, or any other type of spring compressible to produce a clamping force. In the shown example, the inventive nut 600 is designed with an axially extended portion 610 (in relation to the previously shown nut 108) where the recess 602 is formed. On the other end, the nut 600 has an externally threaded portion 612 configured to engage with the internal threading of the sleeve 120 of the base 102, as previously described. The recess 602 may be sized to an axial length that partially accommodates the one or more spring elements 110 in their uncompressed state. Thus, as shown in FIG. 8 (unlocked position), in their uncompressed state, the one or more spring elements 110 partially extend out of the recess 602, preventing contact between an axial end face 604 of the nut 600 and an axial end face 704 of the bolt head 702 of the bolt 700. Furthermore, the axial length of the recess 602 of the nut 600 is sized to fully accommodate the one or more spring elements 110 in a compressed state of the one or more spring elements 110. Thus, as shown in FIG. 9 (locked position), in their compressed state, the one or more spring elements 110 are located completely within the recess in the nut 600, such that the axial end face 604 of the nut 600 directly contacts axial end face 704 of the bolt head 702. Still referring to FIG. 6, the recess 602 is delimited by a wall 606 on one end of the recess 602, such that the one or more spring elements are compressible between the wall 606 and the axial end face 704 of the bolt head 702.

Referring to FIG. 7, the inventive bolt 700 comprises a bolt head 702 and a bolt shaft 706. The bolt head 702 has an axial end face 704 that is configured mechanically engage with the axial end face 604 of the nut 600. The bolt shaft 706 has an externally threaded portion 708 configured to engage with the internal threading of the hollow part of the lock shaft 126, and a shank portion 710 on which the nut 600 is installed. The inventive bolt 700 may be designed to have an enlarged bolt head 702 in relation to the bolt head 132 of the bolt 106 shown in FIG. 1-5. In particular, the bolt head 702 is enlarged by adding material such that its axial end face 704 has increased contact area with the axial end face 604 of the nut 600. In other embodiments, alternate to or in addition to the bolt head, the nut may be enlarged to enhance contact area between the axial end faces of the nut and the bolt head. It is to be noted that the modification to the bolt head and/or nut (adding excess material), while being beneficial in maximizing mechanical torque, may be optional as long it is possible to realize sufficient mechanical torque by engagement between the nut and the bolt head without modification of the bolt head from the configuration shown in FIG. 1-5.

In the shown embodiment, the engaging surfaces 604, 704 (see FIG. 6 and FIG. 7 respectively) may be configured to generate frictional torque upon their engagement responsive to the applied torque, when the one or more spring elements 110 are sufficiently compressed. To that end, in one embodiment, one or both of the surfaces 604 and 704 may be processed to increase or decrease their surface roughness to a defined level, to achieve a required frictional torque opposing the applied torque.

In another variant, the engaging surfaces 604, 704 may be provided with interlocking features, such as ridges and/or grooves. The interlocking features of the surfaces 604, 704, when engaged, would produce a mechanical torque (beyond a frictional torque) to oppose the applied torque. In still other variants, a combination of frictional and interlocking features may be employed.

In a different implementation, a similar effect may be realized by designing a recess into the bolt head instead of the nut. Like in the described embodiment, the recess in the bolt head may be sized to accommodate the one or more spring elements fully in their compressed state but only partially in their uncompressed state. This would ensure that the axial end faces of the bolt head and that of the nut mechanically engage when the one or more spring elements are sufficiently compressed by the applied torque, to generate a mechanical torque (e.g., using frictional and/or interlocking features) to oppose the applied torque. As in the previously described embodiment, the recess in the bolt head may be delimited by a wall such the one or more spring elements are compressible between that wall and the axial end face of the nut.

In yet other implementations, the use of a nut may be obviated, and the features of the nut may be built into the base or into the attachment structure itself. For example, in one embodiment, the first and second mechanically engageable surfaces may be realized by an axial end face of the bolt head and an axial end face of the sleeve of the base, respectively. In another embodiment, the first and second mechanically engageable surfaces may be realized by an axial end face of the bolt head and a surface of the attachment structure (in this example, the surface of the EOT 500 visible in FIG. 5), respectively. In these embodiments, the recess may be formed into either the first surface (on the bolt head) or into the second surface (sleeve or attachment structure). The first and/or second surfaces may be provided with frictional and/or interlocking features, as described above.

Additionally or alternate to the above described embodiments, the mechanically engaging surfaces that generate the opposing mechanical torque may be realized by still other pairs of surfaces. For example, in one embodiment, a first mechanically engaging surface may be realized by the outer surface of the bolt shaft 706, such as in a shank portion 710 of the bolt shaft 706 (see FIG. 7) and a second mechanically engaging surface may be defined at an inner surface 608 of the nut (see FIG. 6) which is configured to mechanically engage with the shank portion responsive to the applied torque. In another embodiment, the first and second surfaces may be realized by an outer surface of the bolt shaft and an inner surface of the sleeve of the base, respectively. The first and/or second surfaces may be provided with frictional and/or interlocking features, as described above.

The assembly of the apparatus 800 is largely similar to that of the apparatus 100, the description of which will not be repeated. In the case of the apparatus 800, as a torque is applied to rotate the locking member 104 from an unlocked to a locked position, the compression of the one or more spring elements due to relative motion between the base and the bolt causes a first surface to mechanically engage with a second surface, to generate a mechanical torque that opposes the applied torque. In one embodiment, the method may involve retrofitting an existing mounting apparatus (such as the apparatus 100) with the improved features as described herein above. The retrofit may involve replacing a used bolt and a used nut with a replacement bolt and a replacement nut that have the features according to any of the above described embodiments.

The system and processes of the figures are not exclusive. Other systems and processes may be derived in accordance with the principles of the disclosure to accomplish the same objectives. Although this disclosure has been described with reference to particular embodiments, it is to be understood that the embodiments and variations shown and described herein are for illustration purposes only. Modifications to the current design may be implemented by those skilled in the art, without departing from the scope of the disclosure.

What is claimed is:

1. An apparatus for mounting an attachment structure to a railroad coupler, the apparatus comprising:

a base comprising a first clamp face, a mounting portion for the attachment structure and an elongated sleeve extending from the mounting portion, the sleeve being insertable through attachment structure, a locking member comprising a hook defining a second clamp face and a lock shaft extending from the hook, the lock shaft being hollow for at least a portion of the length thereof and insertable through a first end of the of the sleeve adjacent the mounting portion, a bolt comprising a bolt head and a bolt shaft, the bolt shaft being insertable through a second end of the sleeve opposite the first end and configured to be in threaded engagement with an inner surface of the hollow portion of the lock shaft after the lock shaft is inserted through the first end of the sleeve, wherein the locking member is configured to be rotated from an unlocked position to a locked position by torque applied via the bolt head, whereby the locking member is pulled inside the sleeve and the second clamp face aligns with the first clamp face to clamp a portion of the railroad coupler therebetween, one or more spring elements configured to be compressible by relative movement between the bolt and the base responsive to the applied torque, to produce a clamping force between the first and second clamp faces, and a first surface and a second surface, the first and second surfaces being arranged such that compression of the one or more spring elements causes the first surface to mechanically engage with the second surface to generate a mechanical torque that opposes the applied torque.

2. The apparatus of claim 1, wherein a recess is formed through one of the first and second surfaces for receiving therein the one or more spring elements, wherein the recess is sized to a length that fully accommodates the one or more spring elements in a compressed state of the one or more spring elements, such that the first surface directly contacts the second surface when the one or more spring elements are compressed, and wherein the length of the recess partially accommodates the one or more spring elements in their uncompressed state, such that the one or more spring elements prevent direct contact between the first surface and the second surface in their uncompressed state.

3. The apparatus of claim 2, wherein the first surface is an axial end face of the bolt head and the second surface is an axial end face of a nut which is installable on the bolt shaft and configured to be tightened into a threaded engagement with an inner surface of the sleeve through the second end of the sleeve.

4. The apparatus of claim 3, wherein the bolt head and/or the nut is enlarged to increase contact area therebetween when the one or more spring elements are compressed.

5. The apparatus of claim 2, wherein the first surface is an axial end face of the bolt head and the second surface is an axial end face of the sleeve of the base or a surface of the attachment structure.

6. The apparatus of claim 2, wherein the recess is delimited by a wall, wherein the one or more spring elements are compressible between the wall and the other of the of the first and second surfaces.

7. The apparatus of claim 1, wherein the first surface is an outer surface of the bolt shaft and the second surface is an inner surface of the sleeve of the base or an inner surface of a nut which is installable on the bolt shaft and configured to be tightened into a threaded engagement with an inner surface of the sleeve through the second end of the sleeve.

8. The apparatus of claim 1, wherein the first surface and the second surface are configured to generate a frictional torque upon mechanical engagement that opposes the applied torque.

9. The apparatus of claim 8, wherein the first surface and/or the second surface are provided with a defined surface roughness based on a required frictional torque.

10. The apparatus of claim 1, wherein the first surface and the second surface are provided with interlocking features, which, when engaged, oppose the applied torque.

11. A method for mounting an attachment structure to a railroad coupler, the method comprising:

arranging:

a base comprising a first clamp face, a mounting portion for the attachment structure and an elongated sleeve extending from the mounting portion, the sleeve having a first end adjacent the mounting portion and a second end opposite the first end, a locking member comprising a hook defining a second clamp face and a lock shaft extending from the hook, the lock shaft being hollow for at least a portion of the length thereof, a bolt having a bolt head and a bolt shaft, and one or more spring elements, inserting the sleeve of the base through the attachment structure, inserting the bolt through the second end of the sleeve, inserting the lock shaft through the first end of the sleeve such that the bolt shaft is in threaded engagement with an inner surface of the hollow portion of the lock shaft, rotating the locking member from an unlocked position to a locked position by torque applied via the bolt head, whereby the locking member is pulled inside the sleeve and the second clamp face aligns with the first clamp face to clamp a portion of the railroad coupler therebetween, wherein the one or more spring elements are compressed by relative movement between the bolt and the base responsive to the applied torque, to produce a clamping force between the first and second clamp faces, wherein compression of the one or more spring elements causes a first surface of the apparatus to mechanically engage with a second surface of the apparatus to generate a mechanical torque that opposes the applied torque.

12. The method of claim 11, wherein a recess is formed through one of the first and second surfaces for receiving therein the one or more spring elements, wherein the recess is sized to a length that fully accommodates the one or more spring elements in a compressed state of the one or more spring elements, such that the first surface directly contacts the second surface when the one or more spring elements are compressed, and wherein the length of the recess partially accommodates the one or more spring elements in their uncompressed state, such that the one or more spring elements prevent direct contact between the first surface and the second surface in their uncompressed state.

13. The method of claim 12, wherein the first surface is an axial end face of the bolt head and the second surface is an axial end face of a nut which is installed on the bolt shaft and tightened into a threaded engagement with an inner surface of the sleeve through the second end of the sleeve.

14. The method according to claim 13, comprising replacing a used bolt and a used nut with a replacement bolt and the replacement nut, wherein the first and second surfaces are defined respectively on the replacement bolt and the replacement nut, wherein the replacement nut and/or replacement bolt are modified in relation to the used nut and/or the used bolt respectively, to enhance a contact area therebetween when the one or more spring elements are compressed.

15. The method of claim 12, wherein the first surface is an axial end face of the bolt head and the second surface is an axial end face of the sleeve of the base or an axial end face of the attachment structure.

16. The method of claim 12, wherein the recess is delimited by a wall, wherein the one or more spring elements are compressible between the wall and the other of the of the first and second surfaces.

17. The method of claim 11, wherein the first surface is an outer surface of the bolt shaft and the second surface is an inner surface of the sleeve of the base or an inner surface of a nut which is installable on the bolt shaft and configured to be tightened into a threaded engagement with an inner surface of the sleeve through the second end of the sleeve.

18. The method of claim 11, wherein the first surface and the second surface are provided with frictional and/or interlocking features.

19. The method of claim 11, comprising fastening the attachment structure at mounting points provided on the mounting portion of the base.

20. The method of claim 11, wherein the attachment structure is an end of train device (EOT).

* * * * *